United States Patent [19]

Lindqvist

[11] Patent Number: 4,781,135

[45] Date of Patent: Nov. 1, 1988

[54] SHIP HULL

[75] Inventor: Gustav Lindqvist, Esbo, Finland

[73] Assignee: Oy Wärtsilä Ab, Helsinki, Finland

[21] Appl. No.: 909,005

[22] Filed: Sep. 16, 1986

Related U.S. Application Data

[63] Continuation of Ser. No. 707,870, Mar. 4, 1985, abandoned.

[30] Foreign Application Priority Data

Mar. 12, 1984 [FI] Finland ..... 840995

[51] Int. Cl.[4] ..... B63B 1/04

[52] U.S. Cl. ..... 114/56; 114/40

[58] Field of Search ..... 114/40, 41, 42, 65 A, 114/67 A, 56, 57, 63, 64

[56] References Cited

U.S. PATENT DOCUMENTS

| | | | |
|---|---|---|---|
| 2,754,791 | 7/1956 | Neiding | 114/67 A |
| 3,489,117 | 1/1970 | Messerschmidt | 114/56 |
| 3,530,814 | 9/1970 | Rastorquev | 114/40 |
| 3,565,029 | 2/1971 | Smit | 114/57 |
| 3,931,780 | 1/1976 | Waas | 114/41 |
| 4,351,255 | 9/1982 | Johansson | 114/41 |
| 4,522,141 | 6/1985 | Aker | 114/40 |

FOREIGN PATENT DOCUMENTS

| | | | |
|---|---|---|---|
| 290965 | 10/1928 | United Kingdom | 114/56 |

*Primary Examiner*—Joseph F. Peters, Jr.
*Assistant Examiner*—Edwin L. Swinehart
*Attorney, Agent, or Firm*—Dellett, Smith-Hill and Bedell

[57] ABSTRACT

A ship hull has a general frame form defining a bottom surface and two side surfaces. The bottom surface of the hull has a horizontal bottom section that extends longitudinally of the hull midway between the two side surfaces of the hull, and the bottom surface of the hull also has two inclined bottom sections that are located entirely below the design waterline plane and are joined to the horizontal bottom section along respective sides thereof and to the side surfaces respectively. Each join is along a clearly defined longitudinal intersection edge, whereby each side of the hull is divided into at least three clearly defined portions. The width of the horizontal bottom section and of each of the inclined bottom sections is at least 20% of the maximum beam of the hull, and the inclined bottom sections extend over a substantial part of the length of the hull.

38 Claims, 3 Drawing Sheets

Figure 1:
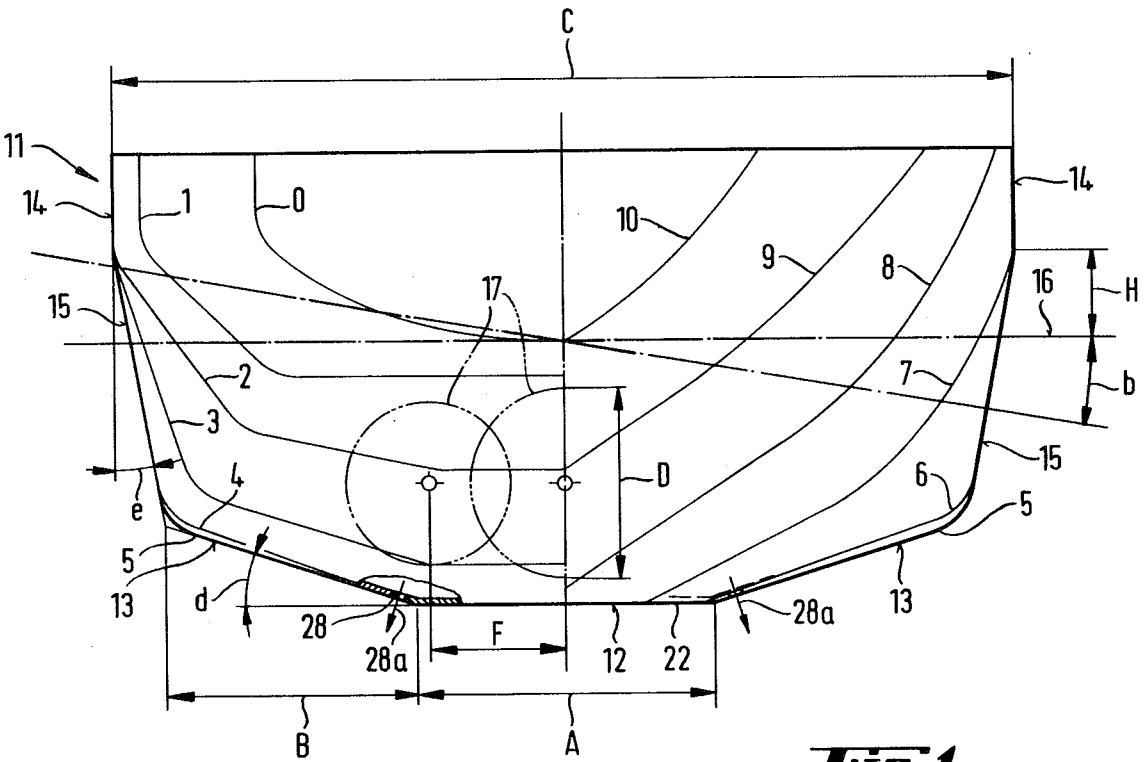

L
M
C
11
12
13
15
16
17
18
19
20
22
23
24
25
26
27
28

SHIP HULL

This is a continuation of application Ser. No. 707,870, filed Mar. 4, 1985, and now abandoned.

BACKGROUND OF THE INVENTION

This invention relates to a ship hull adapted for operation in ice-filled waters.

As a ship moves through an ice field, chunks of ice in front of the ship are forced below the surface of the water by virtue of the ship's forward movement. The chunks of ice then slide along the external suface of the underwater part of the hull. Some of the chunks of ice slide along the bottom surface of the hull, thereby easily obstructing the ship's propeller. This reduces propeller efficiency, and the chunks of ice can also cause damage to the propeller. The chunks of ice which slide along the side surfaces of the ship can also get into the ship's propeller, particularly in twin or triple propeller ships.

The purpose of the invention is to create a favorable hull form for a ship operating in icy waters, so that chunks of ice will be directed in such a way as to have as small an adverse effect as possible on the forward movement of the ship.

The configuration of the hull of a ship is conveniently illustrated by means of its so-called frame form, which shows the external cross-section of the hull at a defined location along the length of the ship. Several frame forms may be illustrated in a single figure (such as FIG. 1 of the accompanying drawings). The main frame form is the frame form midway along the hull's design waterline length.

For convenience of nomenclature, the "side surfaces" of the hull are those portions of the hull, extending downwards from the top of the hull at port and starboard respectively, which are vertical or are inclined to the vertical at a smaller angle than to the horizontal, and the "bottom surface" of the hull is that portion of the hull, beneath the side surfaces, which is inclined to the horizontal at a smaller angle than to the vertical.

It will be appreciated that in order to maximize the internal volume, or cubic capacity, of a ship's hull, within given overall dimensions, the hull is normally constructed so that its middle section is of substantially uniform beam, and the hull's bottom surface, within the middle section, is made as wide as possible within the limits determined by the sides of the ship.

According to a first aspect of the present invention, there is provided a ship having a hull defining a bow having a substantially V-shaped form in the waterline plane of the ship, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined bottom sections that are located entirely below said design waterline plane and are joined to the horizontal bottom section along respective sides thereof and to the side surfaces respectively, each such join being along a clearly defined longitudinal intersection edge, whereby each side of the hull is divided into at least three clearly defined portions, the width of said horizontal bottom section of each of the inclined bottom sections being at least 20% of the maximum beam of the hull, and the inclined bottom sections extending over a substantial part of the length of the hull.

According to a second aspect of the present invention there is provided a ship hull defining a bow having a substantially V-shaped form in the design waterline plane of the hull, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined bottom sections that are located entirely below said design waterline plane and are joined to the horizontal bottom section along respective sides thereof and to the side surfaces respectively, each such join being along a clearly defined longitudinal intersection edge, whereby each side of the hull is divided into at least three clearly defined portions, the width of said horizontal bottom section and of each of the inclined bottom sections being at least 20% of the maximum beam of the hull, and the inclined bottom sections extending over a substantial part of the length of the hull.

In the case of a ship embodying the first aspect of the invention, or a ship having a hull embodying the second aspect of the invention, very few chunks of ice go under the horizontal bottom section of the hull because it is quite narrow. Owing to their buoyancy, the chunks of ice which go under the inclined bottom section move towards the sides. Since the bow of the ship is substantially V-shaped in the waterline plane, the bow's main section has a wedge-shaped form in horizontal cross section, and this pushes the ice to the sides. However, it is not essential to the invention that the very front part of the bow at the design waterline be sharp. The bow can be designed in the manner described in U.S. Pat. No. 4,351,255.

In a preferred embodiment of the invention, which is intended for operation in extremely difficult ice conditions, the lower part of each side surface is inclined. It is also important for the horizontal bottom section and the inclined bottom section together to extend over a considerable proportion of the length of the ship. In practice this means that the length of that part of the ship which has the defined general frame form extends over at least 20% and preferably at least 30% of the ship's design waterline length. It is most desirable that the defined general frame form applies to the form of the main frame of the ship. If the ship has a middle section of uniform beam whose length is at least 25% of the ship's waterline length, it is preferred that the defined general frame form should apply at a point whose distance to the rear from the foremost point of the ship's middle section of uniform beam is 20% of the design waterline length, provided that this point is forward of the main frame.

As indicated previously, if the horizontal bottom section is made too narrow, the hull will have an unfavorable cubic capacity because the ship's internal volume is small in relation to the ship's overall dimensions. Owing to this, it is most advantageous for the horizontal bottom section to be at least 30% of the ship's maximum beam. If the ship only has a single propulsion propeller, the width of the horizontal bottom section should preferably be at least as large as the diameter of the propulsion propeller. If twin propellers are used for the ship's propulsion, the total width of the horizontal bottom section should preferably be at least 80% of the distance between the axes of these propellers. The horizontal bottom section may be of uniform beam for at least part of its length forward of the point where the bottom line of the ship begins to rise towards the stern of the ship. The horizontal bottom section may even become wider towards the stern. In the latter case, a more favorable hull form in terms of cubic capacity is obtained and at the same time more effective steering of the chunks of ice towards the sides is achieved. The horizontal bottom section may then advantageously be narrow at the forward narrowing section of the ship, for instance having a width of no more than 15% of the maximum beam of the ship. At the point of the bow section, where the bottom line of the hull proper of the ship rises in the forward direction, the horizontal bottom section may be at the bottom of a wedge-shaped structure protruding downwards from the hull proper of the ship.

If the ship has side surfaces that are inclined to the vertical, the angle of inclination should not be made too large because the hull's cubic capacity is then adversely affected.

The angle of inclination of the side surfaces is preferably smaller than the angle between the inclined bottom section and the horizontal plane. This too favorably affects the guiding of the chunks of ice. The angle of inclination of the inclined bottom section in relation to the horizontal plane is preferably between 5 and 30 degrees, more preferably from 8 degrees to 20 degrees. In a particularly preferred embodiment of the invention, the side surface has an inclined section that extends upwards from the outer edge of the inclined bottom section so far above the ship's design waterline that its end point remains above the waterline even when the ship heels to the maximum angle for which the ship is designed. The inclined bottom section preferably extends in the longitudinal direction of the ship both backwards and forwards at least to the point where the ship's bottom line begins to rise and in the aft direction preferably extends a considerable distance farther than that point.

In a hull embodying the invention it is very advantageous to use the air bubbling system described in U.S. Pat. No. 3,580,204. Air discharge openings are located at the lower edge of the inclined bottom section, whereby the hull form enhances the beneficial effect of the bubbling and the bubbling also enhances the beneficial effect of the hull form. It is advisable to provide the air discharge openings over that longitudinal section of the hull for which the ship's bottom line is substantially horizontal. It is also advantageous to arrange air discharge openings forward of this section. This can easily be done, if the bow section of the ship has a structure that extends downwards from the hull proper as has already been described. A hull form with an inclined side surface below the waterline best enhances the effect of air bubbling.

Figure 2:
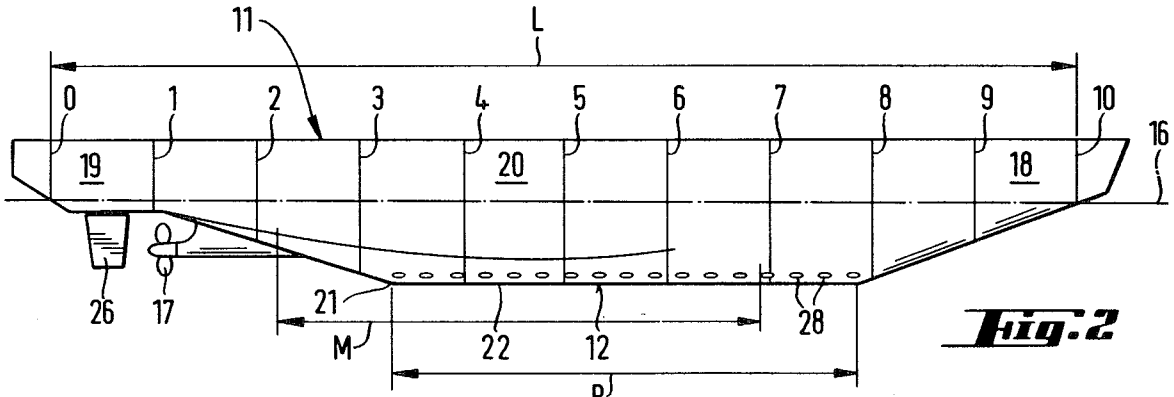
Figure 3:
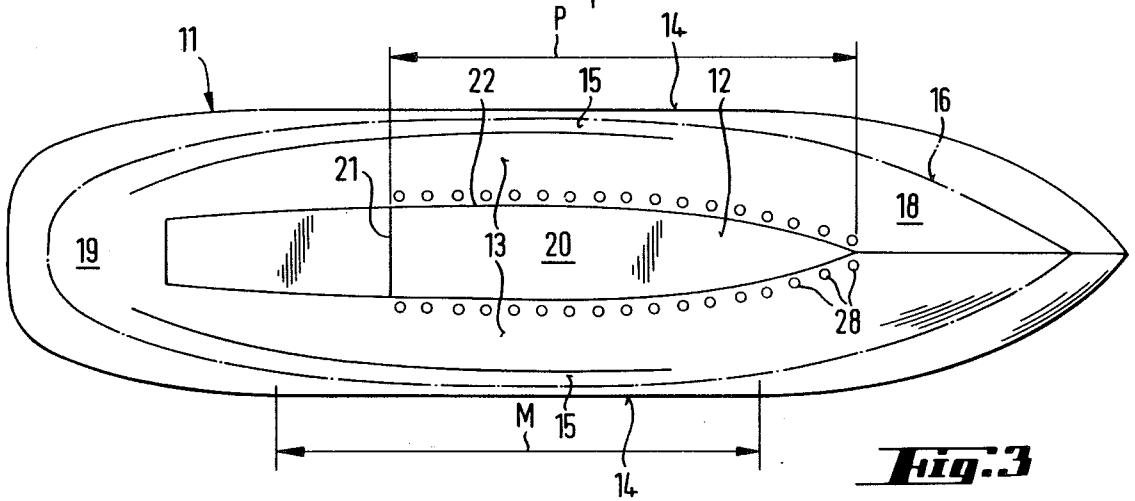
Figures 4, 5, 6, 7:
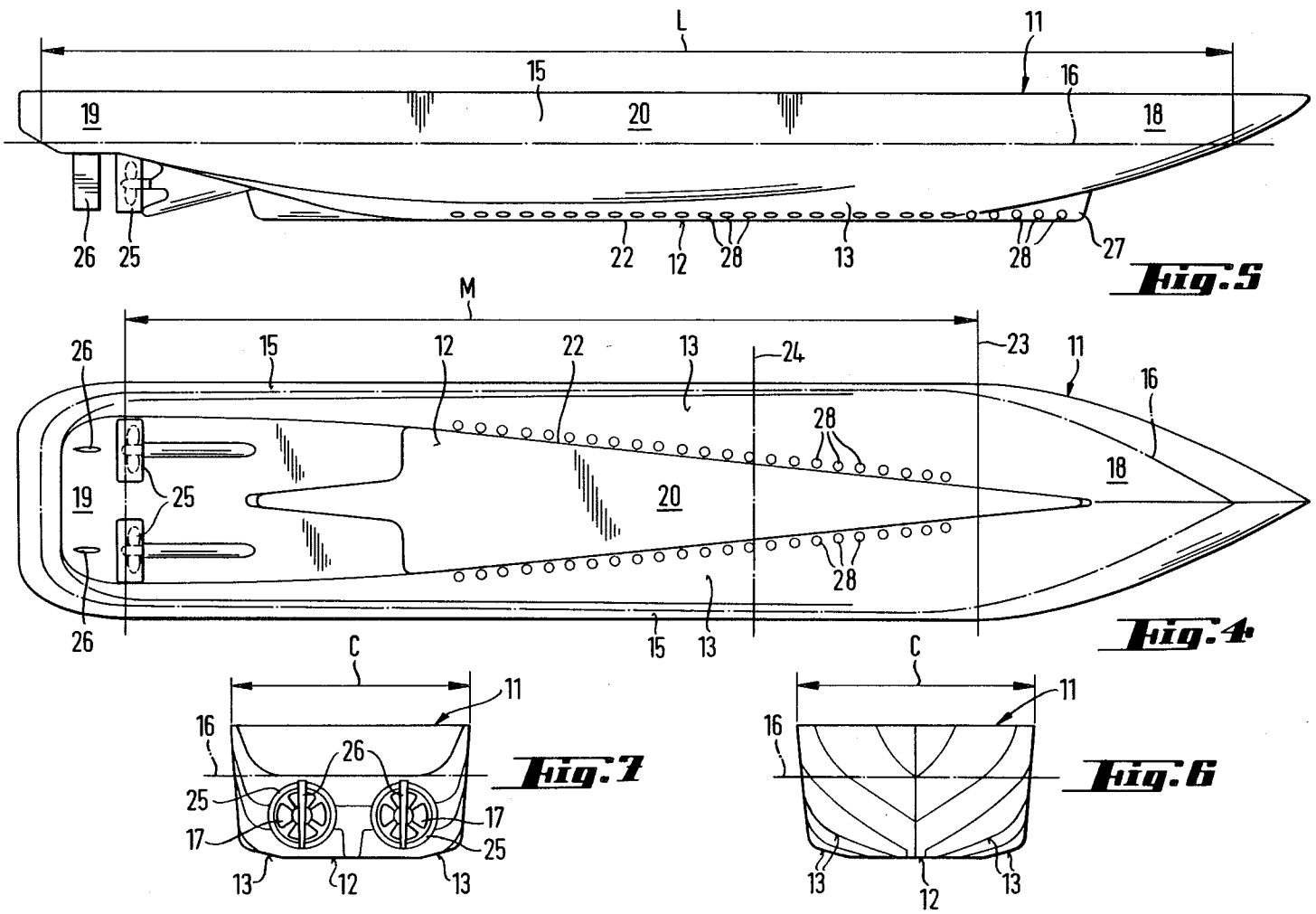

The invention will now be described in detail, referring, by way of example, to the attached drawings, in which FIG. 1 represents schematically the frame forms of a first ship hull in such a way that the left side shows the hull as a rear view and the right side shows the hull as a front view, FIG. 2 is a schematic side elevation of the ship hull shows in FIG. 1, FIG. 3 is a bottom plan view of the ship hull shown in FIG. 1, FIG. 4 is a bottom plan view of a second ship hull, FIG. 5 is a side elevation of the ship hull shown in FIG. 4, FIG. 6 is a front elevation of the ship hull shown in FIG. 4, and FIG. 7 is a rear elevation of the ship hull shown in FIG. 4.

The frame form lines 0 to 10 shown in FIG. 1 correspond to the eleven cross sections 0 to 10 shown in FIG. 2. Sections 0 and 10 are at the end points of the ship's design waterline. The distance L from cross sectional plane 0 to cross sectional plane 10 is thus the ship's design waterline length. The distance between each two adjacent cross sectional planes in FIG. 2 is 10% of the ship's design waterline length. The cross-section 5 is the ship's main frame. The cross-sectional diagrams should not be taken to imply that there would necessarily be a structural frame member at the cross section location in question.

In the drawings, 11 denotes the ship's hull, 12 its horizontal bottom section, and 13 its inclined bottom section. The maximum width of the horizontal bottom section 12 is A and the maximum width of the inclined bottom section 13 is B. The dimension B is measured in horizontal plane. Both dimensions A and B are at least 20% of the ship's maximum beam C. Dimension A is also no less than 30% of the maximum beam C at least in the position of main frame 5. Dimension A in a single propeller ship is at least as large as the diameter D of the propeller 17 and in a twin propeller ship at least 80% of the distance 2F between the axes of the propellers 17. Between the frames 2 and 7, the side of the ship consists of two parts, the upper vertical side part 14 and the lower inclined side part 15, which extends a distance H above the ship's design waterline plane 16. The distance H should preferably be such that part of the inclined side section 15 remains above the waterline even when the ship heels to the maximum angle of inclination b taken into account in the ship's design.

Between the frames 2 and 7, the ship's frame form has four discontinuities, which are at the junctures of the bottom sections 12 and 13 and of the bottom sections 13 and the side sections 15. Preferably, these junctures are sharp, but it might be necessary, especially in the ship's bow, for the junctures at least between sections 13 and 15 to be somewhat curved. The radius of curvatures is at any rate kept as small as possible taking into account the general design of the hull. The cross sectional form of the inclined bottom section 13 and/or the side section 15 may be somewhat curved, but this usually increases the ship's construction costs without countervailing improvements so far as performance in ice conditions is concerned.

In the case of the ship shown in FIG. 1, the angle d between the inclined bottom section 13 and the horizontal plane is greater than the angle e between the inclined side surface 15 and the vertical plane. Angle d is generally between 5 degrees and 30 degrees and preferably from 8 degrees to 20 degrees.

When the ship is viewed in the design waterline plane and at other horizontal sections, it has a substantially V-shaped bow section 18 and a narrowing stern section 19. The ship's midsection 20 is of uniform beam and occupies the distance M between the bow and stern sections. That part of the ship where its bottom line 22 is substantially horizontal when viewed from the side (FIG. 2) is indicated by the letter P. The horizontal bottom section 12 extends backwards with a uniform width to the end point 21 of section P, where the ship's bottom line 22 begins to rise. The inclined bottom section 13 also extends backwards beyond the point 21.

FIGS. 4–7 show a ship in which the width of the horizontal bottom section 12 increases in the direction towards the stern of the ship. In this case, the horizontal bottom section is substantially triangular in shape, as viewed in bottom plan (FIG. 4). In the case of FIGS. 4–7, dimension M, or the ship's middle part 20 having a uniform beam, is long. In this kind of ship, where dimension M is at least 25% of the ship's design waterline length L, the most important portion where the frame form that is characteristic of the invention should be applied is the portion that is to the rear of the forward end 23 of the section 20 by a distance equal to 20% of the ship's design waterline length L. This theoretical checkpoint is shown as number 24 in FIG. 4. However, this checkpoint is never located to the rear of the midpoint of the design waterline length L, that is, to the rear of the ship's main frame.

The ship shown in FIGS. 4–7 has two propulsion propellers 17 fitted in respective nozzles 25. The rudders 26 are behind the two propellers.

In the case of FIGS. 1–3, the horizontal bottom section 12 ends at that point in the forward part of the ship where the bottom line 22 starts to rise. The ship shown in FIGS. 4–7 can be constructed in a similar manner, where the horizontal bottom section 12 would end approximately at the position of section plane 23. It is, however, possible to continue the horizontal bottom section 12 forwards in such a way that a protruding wedge-shaped structure 27 is formed, extending downwards and forwards from the hull proper. The bottom surface of the wedge-shaped structure forms the forwardmost part of the horizontal bottom section 12. When the horizontal bottom section widens towards the rear, it is preferred that its forward end is narrower than 15% of the ship's maximum beam C.

It is very advantageous to use the previously mentioned air bubbling system in a ship embodying the invention in such a way that the air discharge openings 28 are arranged at the lower edge of the inclined bottom sections 13. In FIG. 1 these openings and the air discharging through them are symbolized by means of arrows 28*a*. It is advisable to locate the openings 28 as close to the junctures of the inclined bottom section 13 and the horizontal bottom section 12 as structural considerations permit. As FIG. 2 shows, there are air discharge openings 28 over the entire length of the section P.

In a ship having a wedge-shaped structure 27 protruding downward and forward from the hull proper toward the bow, it is advantageous to locate air discharge openings 28 also in this part of the vessel. This makes it possible to bring air discharge openings located at a low level nearer the ship's bow, which otherwise is impossible because the underwater bow line of a ship designed for use in icy conditions is generally very strongly inclined to the vertical.

It will be appreciated by those skilled in the art that the present invention is not restricted to the particular hull configurations that have been shown as described, and that variations may be made therein without departing from the scope of the invention as defined in the appended claims, and equivalents thereof.

I claim:

1. A ship having a hull defining a bow having a substantially V-shaped form in the design waterline plane of ship, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined sections that are located entirely below said design waterline plane and are joined to the bottom section along respective sides thereof and to the side surfaces respectively, each such join being along a clearly defined longitudinal intersection edge, the width of said section and of each of the inclined sections being at least 20% of the maximum beam of the hull, and the inclined sections extending over a substantial part of the length of the hull.

2. A ship according to claim 1, wherein each side surface has at least a lower part that is inclined outwards in the upward direction.

3. A ship according to claim 2, wherein the angle formed between said inclined section and a horizontal plane is greater than the angle formed between said lower part of the side surface and a vertical plane.

4. A ship according to claim 2, wherein said lower part of the side surface extends above the design waterline plane for such a distance that it remains above the waterline plane even when the ship heels to the maximum angle for which it is designed.

5. A ship according to claim 1, wherein each side surface has at least an upper part that is vertical.

6. A ship according to claim 1, wherein said bottom section and said inclined sections each extend in the longitudinal direction of the hull over at least 20% of the length of the hull in the design waterline plane.

7. A ship according to claim 6, wherein said bottom section and said inclined sections each extend over at least 30% of the length of the hull in the design waterline plane.

8. A ship according to claim 1, wherein the width of said bottom section is at least 30% of the maximum beam of said hull.

9. A ship according to claim 1, having a single propulsion propeller, wherein the width of said bottom section is at least equal to the diameter of said single propeller.

10. A ship according to claim 1, having two propulsion propellers, wherein the width of said bottom section is at least 80% of the distance between the rotation axes of said propellers.

11. A ship according to claim 1, wherein each inclined section, in a cross-section of the hull, is of substantially constant inclination over its entire width from the bottom section to the side surface to which it is joined.

12. A ship according to claim 1, having two propulsion propellers and wherein the width of the bottom section is at least 80 percent of the distance between the rotation axes of said propellers and said inclined section extends towards the rear of the hull beyond the point at which the bottom line of the hull is inclined upwards towards the rear of the hull.

13. A ship according to claim 1, wherein said general frame form is present at the cross section of the hull that is longitudinally in the middle of the hull in the design waterline plane.

14. A ship according to claim 1, having a middle hull portion of substantially uniform beam extending over at least 25% of the length of the design waterline plane, wherein said general frame form is present at the cross-section of the hull that is longitudinally in the middle of the hull in the design waterline plane.

15. A ship according to claim 1, having a middle hull portion of substantially uniform beam extending over at least 25% of the length of the hull in the design waterline plane, wherein said general frame form is present at a cross-section of the hull that is aft of the forward end of the middle hull portion by a distance equal to 20% of the length of the hull in the design waterline plane and is forward of the section that is longitudinally in the middle of the hull in the design waterline plane.

16. A ship according to claim 1, wherein the rear portion of said bottom section has substantially uniform width over that part of the hull where the bottom line of said hull is mainly horizontal, viewed from the side of the ship, and extends aft of said part of the hull.

17. A ship according to claim 1, wherein said horizontal bottom section increases in width towards the rear of the hull over a substantial portion of the length of the hull aft of the cross-section of the hull that is longitudinally in the middle of the hull in the design waterline plane.

18. A ship according to claim 17, wherein the width of said bottom section is, at the forward end of said bottom section, less than 15% of the maximum beam of the hull.

19. A ship according to claim 17, wherein said bottom section is located at the bottom of a horizontally wedge-formed construction that protrudes from the hull at a forward region of said hull where the bottom line of the hull proper, as viewed from the side of the ship, is inclined upwards.

20. A ship according to claim 1, wherein said inclined section extends towards the rear of the hull beyond the point at which the bottom line of the hull is inclined upwards towards the rear of the hull.

21. A ship according to claim 1, wherein each side surface has a lower part that is inclined outwards in the upwards direction and an upper part that is substantially vertical, and the lower part of the side surface extends above the design waterline plane for such a distance that the upper part remains above the waterline plane even when the ship heels to the maximum angle for which it is designed.

22. A ship according to claim 21, wherein the angle of inclination to the vertical of the lower part of the side decreases in the forward direction of the ship over a substantial portion of the length of the hull aft of the cross-section of the hull that is longitudinally in the middle of the hull in the design waterline plane, and the width the bottom surface of the hull increases in the forward direction over said substantial portion of the length of the hull.

23. A ship according to claim 1, wherein the angle between said inclined section and a horizontal plane, measured in a plane that is cross-sectional of the hull, remains substantially constant over a substantial portion of the length of the hull aft of the cross-section of the hull that is longitudinally in the middle of the hull in the design waterline plane, and the depth of the bottom section beneath the design waterline plane decreases in the aft direction of the ship over said substantial portion of the length of the hull.

24. A ship according to claim 1, wherein each side surface has, over a substantial part of the length of the hull in the design waterline plane, an upper part that is substantially vertical and is disposed wholly above the design waterline plane and a lower part that extends both below and above the design waterline plane and is inclined outwards in the upward direction.

25. A ship according to claim 24, wherein the angle of inclination to vertical of the lower part of the side surface is smaller at a first location that is longitudinally in the middle of the hull in the design waterline plane than at a second location that is aft of said first location by at least 20 percent of the length of the hull in the design waterline plane.

26. A ship having a hull defining a bow having a substantially V-shaped form in the design waterline plane of the ship, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined sections that are each inclined relative to a horizontal plane at an angle from 5 degrees to 30 degrees, the inclined sections being located entirely below said design waterline plane and being joined to the bottom section along respective sides thereof and to the side surfaces respectively, each such join being along a clearly defined longitudinal intersection edge, the width of said section and of each of the inclined sections being at least 20% of the maximum beam of the hull, and the inclined sections extending over a substantial part of the length of the hull.

27. A ship according to claim 26, wherein:

(a) each side surface has at least a lower part that is inclined outwards in the upwards direction and extends above the design waterline plane for such a distance that it remains above the waterline plane even when the ship heels to the maximum angle for which it is designed, (b) said bottom section and said inclined sections each extend in the longitudinal direction of the hull over at least 30% of the length of the hull in the design waterline plane, (c) the angle formed between said inclined sections and a horizontal plane is from 8 degrees to 20 degrees and is greater than the angle formed between said lower part of the side surface and a vertical plane, (d) the ship has a middle hull portion of substantially uniform beam extending over at least 25% of the length of the hull in the design waterline plane, and (e) said general frame form is present at a cross-section of the hull that is aft of the forward end of the middle hull portion by a distance equal to 20% of the length of the hull in the design waterline plane and is forward of the section that is longitudinally in the middle of the hull in the design waterline plane.

28. A ship according to claim 26, wherein the angle of inclination of the inclined bottom sections relative to a horizontal plane is from 8 degrees to 20 degrees.

29. A ship hull defining a bow having a substantially V-shaped form in the design waterline plane of the hull, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined sections that are located entirely below said design waterline plane and are joined to the bottom section along respectively sides thereof and to the side surfaces respectively, each such join being along a clearly defined longitudinal intersection edge, the width of said bottom section and of each of the inclined sections being at least 20% of the maximum beam of the hull, and the inclined sections extending over a substantial part of the length of the hull.

30. A hull according to claim 29, wherein said horizontal bottom section increases in width towards the rear of the hull over a substantial portion of the length of the hull aft of the cross-section of the hull that is longitudinally in the middle of the hull in the design waterline plane.

31. A hull according to claim 30, wherein the width of said bottom section is, at the forward end of said bottom section, less than 15% of the maximum beam of the hull.

32. A hull according to claim 30, wherein said bottom section is located at the bottom of a horizontally wedge-formed construction that protrudes from the hull at a forward region of said hull where the bottom line of the hull proper, as viewed from the side of the hull, is inclined upwards.

33. A ship hull according to claim 29, wherein each side surface has a lower part that is inclined outwards in the upwards direction and an upper part that is substantially vertical, and the lower part of the side surface extends above the design waterline plane for such a distance that the upper part remains above the waterline plane even when the hull heels to the maximum angle for which it is designed.

34. A hull according to claim 33, wherein the angle of inclination to the vertical of the lower part of the side surface decreases in the forward direction of the hull over a substantial portion of the length of the hull aft of the cross-section of the hull that is longitudinally in the middle of the hull in the design waterline plane, and the width the bottom surface of the hull increases in the forward direction over said substantial portion of the length of the hull.

35. A hull according to claim 29, wherein the angle between said inclined section and a horizontal plane, measured in a plane that is cross-sectional of the hull, remains substantially constant over a substantial portion of the length of the hull aft of the cross-section of the hull that is longitudinally in the middle of the hull in the design waterline plane, and the depth of the bottom section beneath the design waterline plane decreases in the aft direction of the hull over said substantial portion of the length of the hull.

36. A ship having a hull defining a bow having a substantially V-shaped form in the design waterline plane of the ship, and having a general frame form defining a bottom surface and two side surfaces, the bottom surface of the hull having a bottom section that is horizontal in a cross-section of the hull and extends longitudinally of the hull midway between the two side surfaces of the hull, and the bottom surface of the hull also having two inclined sections that are located entirely below said design waterline plane and are joined to the bottom section along respective sides thereof and to the side surfaces respectively, each such join being along a clearly defined longitudinal intersection edge, the width of said bottom section and of each of the inclined sections being at least 20 percent of the maximum beam of the hull, and the inclined sections extending over a substantial part of the length of the hull, and the ship comprising an air bubbling system with air discharge openings located at the lower edges of said inclined sections and dimensioned for the discharge of air into the water, such that rising bubbles create strong ascending water streams.

37. A ship according to claim 36, wherein said openings are located over that longitudinal portion of the hull where the bottom line of the hull is substantially horizontal as viewed from the side of the ship.

38. A ship according to claim 37, wherein the openings are located in a horizontally wedge-shaped construction protruding from the hull at a forward region of the hull.

* * * * *